US006644931B2

(12) United States Patent
Puech

(10) Patent No.: US 6,644,931 B2
(45) Date of Patent: Nov. 11, 2003

(54) SYSTEM FOR PUMPING LOW THERMAL CONDUCTIVITY GASES

(75) Inventor: Michel Puech, Metz-Tessy (FR)

(73) Assignee: Alcatel, Paris (FR)

( * ) Notice: Subject to any disclaimer, the term of this patent is extended or adjusted under 35 U.S.C. 154(b) by 44 days.

(21) Appl. No.: 10/098,298

(22) Filed: Mar. 18, 2002

(65) Prior Publication Data

US 2002/0131870 A1 Sep. 19, 2002

(30) Foreign Application Priority Data

Mar. 19, 2001 (FR) ..... 01 03678

(51) Int. Cl.[7] ..... F04B 23/08; F04B 23/12; F04B 12/00

(52) U.S. Cl. ..... 417/205; 417/199.1; 417/206; 417/423.4

(58) Field of Search ..... 417/199.1, 199.2, 417/206, 205, 307, 428, 423.4, 423.5

(56) References Cited

U.S. PATENT DOCUMENTS 3,536,418 A * 10/1970 Breaux ..... 417/49
3,922,110 A * 11/1975 Huse ..... 417/2
4,504,201 A 3/1985 Wycliffe
4,694,734 A * 9/1987 Nomura et al. ..... 92/130 R
5,259,735 A * 11/1993 Takahashi et al. ..... 417/203
5,356,673 A * 10/1994 Schmitt et al. ..... 427/446
5,584,669 A 12/1996 Becker
5,709,537 A 1/1998 Maruyama et al.
5,947,694 A 9/1999 Hablanian
2003/0068233 A1 * 4/2003 Royce et al.

FOREIGN PATENT DOCUMENTS

DE 37 10 782 A1 10/1988
DE 44 43 387 C1 1/1996
EP 0 931 939 A2 7/1999

* cited by examiner

*Primary Examiner*—Charles G. Freay
*Assistant Examiner*—Timothy P. Solak
(74) *Attorney, Agent, or Firm*—Sughrue Mion, PLLC

(57) ABSTRACT

In a vacuum pumping system according to the invention, the Roots or claw multistage dry primary pump discharges into an outlet stage including an additional piston or membrane pump connected in parallel with a preliminary evacuation pipe including a check valve. The outlet stage very significantly reduces heating of the primary pump and thereby enables the vacuum pumping system to pump efficiently and without damage gases with a low thermal conductivity, such as argon or xenon.

9 Claims, 3 Drawing Sheets

SYSTEM FOR PUMPING LOW THERMAL CONDUCTIVITY GASES

CROSS-REFERENCE TO RELATED APPLICATIONS

This application is based on French Patent Application No. 01 03 678 filed Mar. 19, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to vacuum pumping systems with a multistage Roots or "claw" multilobe dry primary pump, in which systems the inlet of the primary pump receives the gases to be pumped and the outlet of the primary pump discharges the pumped gases to the atmosphere or to a system for recycling the pumped gases.

2. Description of the Prior Art

Diverse industries, for example the semiconductors industry, employ fabrication processes in a controlled low-pressure atmosphere in a vacuum enclosure connected to a vacuum pumping system.

To establish and maintain a vacuum in the vacuum enclosure, the vacuum pumping system must, initially, pump a relatively large flow of gas to create vacuum; the vacuum pumping system then extracts from the vacuum enclosure the residual gases or the treatment gases intentionally introduced into the vacuum enclosure during the various controlled atmosphere fabrication process steps. The flows of gas to be pumped by the vacuum pumping system are then lower.

A permanent concern, in the semiconductors industry in particular, is to maintain a high purity of the gases contained in the vacuum enclosure. To this end, it is necessary to avoid retrograde pollution from the vacuum pumping system. In particular, this rules out the use of vacuum pumping systems including liquid ring pumps. In modern techniques, vacuum pumping systems are based on Roots or claw dry pumps.

On the other hand, the treatment gases introduced intentionally into the vacuum enclosure are frequently costly gases, and it is advantageous to recycle these gases at the outlet from the vacuum pumping system, by means of a pumped gas recycling system, in order thereafter to reintroduce them in a controlled manner into the vacuum enclosure. It is then necessary to avoid contaminating these gases as they pass through the vacuum pumping system, and this is a second reason for using Roots or claw dry primary pumps, rather than traditional primary pumps with an oil seal.

Accordingly, in prior art vacuum pumping systems using Roots or claw dry primary pumps, the inlet of the primary pump receives the gases to be pumped, either directly from the vacuum enclosure, or indirectly via a secondary pump, which can be a turbomolecular pump. The primary pump discharges the pumped gases directly to the atmosphere or directly to a pumped gas recycling system.

Diverse industries have to pump and recycle pure low thermal conductivity gases, such as argon or xenon. This is the case in the semiconductors industry in particular, in which these gases are used in light sources emitting in the far ultraviolet spectrum in photolithographic equipment for fabricating new generation electronic circuits.

In this type of application, these very pure gases are used at a low pressure in the vacuum enclosure, and are evacuated by a pumping system using a Roots multistage dry primary pump or a claw multilobe dry primary pump.

In a multistage pump, the gas to be evacuated is aspirated by the first stage of the pump and then compressed in subsequent stages to a pressure slightly greater than atmospheric pressure at the outlet of the last stage and then rejected to the atmosphere or discharged to a pumped gases recycling system.

It has been found that prior art vacuum pumping systems using Roots multistage dry pumps or claw multilobe dry pumps have a serious drawback if pure low thermal conductivity gases, such as argon or xenon, are introduced into the vacuum enclosure during process steps. This is because the presence in the pumped gases of a high content of pure low thermal conductivity gas, such as argon or xenon, leads very quickly to binding and destruction of the dry primary pump.

The fast binding and destruction of the pump are due to binding of the last stage of the pump, stage which discharges the gases at a pressure close to atmospheric pressure.

The explanation for this is found in the following analysis: in a multistage dry pump, regardless of its technology, the gas is compressed in the successive stages of the pump, from the aspiration pressure at the inlet of the first stage to atmospheric pressure at the outlet of the final stage. In each compression stage the gas is heated and heats the adjacent pump parts. The compression is not regular, however, and the greatest compression occurs in the final stage. A compression greater than $5\times10^4$ Pa is generally obtained in the final stage. It is thus in the final stage that the gas is heated the most and therefore that most of the energy in the form of heat must be dissipated.

The structure of dry primary pumps includes a stator in which rotate two mechanically coupled rotors and offset laterally relative to each other. The rotors are supported by bearings, and are separated from the stator by the thin layer of gas in the mechanical clearances between the rotor and the stator or the pump body. A very small portion of the heat in a stage of the pump is dissipated by conduction to the pump body through the shaft of the rotor, and the greater portion of the heat is dissipated by conduction through the thin layer of gas between the rotor and the stator.

When pumping low thermal conductivity gas, the gas opposes the transfer of heat between the rotor and the stator. As a result of this, in the final stage of the multistage primary pump, the temperature of the rotor quickly increases to a very high temperature, a consequence of which is expansion of the rotor so that it comes into contact with the stator, leading to binding and destruction of the primary pump.

To prevent this phenomenon, one solution that has already been proposed entails injecting into the intermediate stages of the pump a high thermal conductivity gas such as nitrogen or helium. However, these additive gases are then mixed with the pure gas, and prevent simple recycling.

Another prior art solution entails intentionally increasing the functional clearances of the final stage to lower its compression ratio and thereby reduce the heat to be evacuated. However, the pump is then no longer able to achieve the required performance, and it is therefore necessary to distribute the loss of compression ratio over a large number of supplementary stages, which leads to a complex and bulky pump.

The problem addressed by the present invention is therefore that of designing a new vacuum pumping system structure that avoids destruction of the dry primary pump when pumping a low thermal conductivity gas, that uses prior art multistage dry primary pumps without modifying them, and that, where applicable, retains the same recycling technique, thus avoiding the need to develop a new pump.

SUMMARY OF THE INVENTION

To achieve the above and other objects, a vacuum pumping system in accordance with the invention includes a Roots or claw multistage dry primary pump which has an inlet adapted to receive gases to be pumped and an outlet adapted to discharge pumped gases to the atmosphere or to a pumped gases recycling system. In accordance with the invention, the vacuum pumping system includes an additional pump which has an inlet connected to the outlet of the primary pump and an outlet that discharges to the atmosphere or to the pumped gases recycling system. A preliminary evacuation pipe is connected in parallel with the additional pump, and includes a check valve adapted to pass gases coming from the primary pump. The additional pump is a dry pump that uses a technology other than the Roots or claw technology and is adapted to withstand without damage the temperature increase due to the final compression of the pumped gases.

In a first embodiment, the additional pump is a membrane pump.

In another embodiment, the additional pump is a piston pump.

The additional pump must be rated so that it is capable of pumping all of the flow of gas passing through the vacuum pumping system during the steps of pumping a vacuum at low pressure, for example to pump the flow of process gases during low-pressure fabrication process steps executed in a vacuum enclosure.

The additional pump can preferably be rated so as to be just capable of pumping said flow of gas when pumping a vacuum at low pressure. An additional pump that is small and inexpensive can therefore be used which is nevertheless sufficient to eliminate the problem of destruction of the dry primary pump.

The preliminary evacuation pipe must be rated to pass the high gas flow during preliminary evacuation steps of a vacuum enclosure.

The vacuum pumping system according to the invention can be connected to a vacuum enclosure containing, or into which are injected, low thermal conductivity gases.

The low thermal conductivity gases can include argon or xenon.

The pumped gases are advantageously discharged at the outlet of the vacuum pumping system into a pumped gases recycling system. The pumped gas recycling system extracts and recycles said low thermal conductivity gases to re-inject them in a controlled manner into the vacuum enclosure.

Other objects, features and advantages of the present invention will emerge from the following description of particular embodiments of the invention, which description is given with reference to the accompanying drawings.

DETAILED DESCRIPTION OF THE PREFERRED EMBODIMENTS

Figure 1:
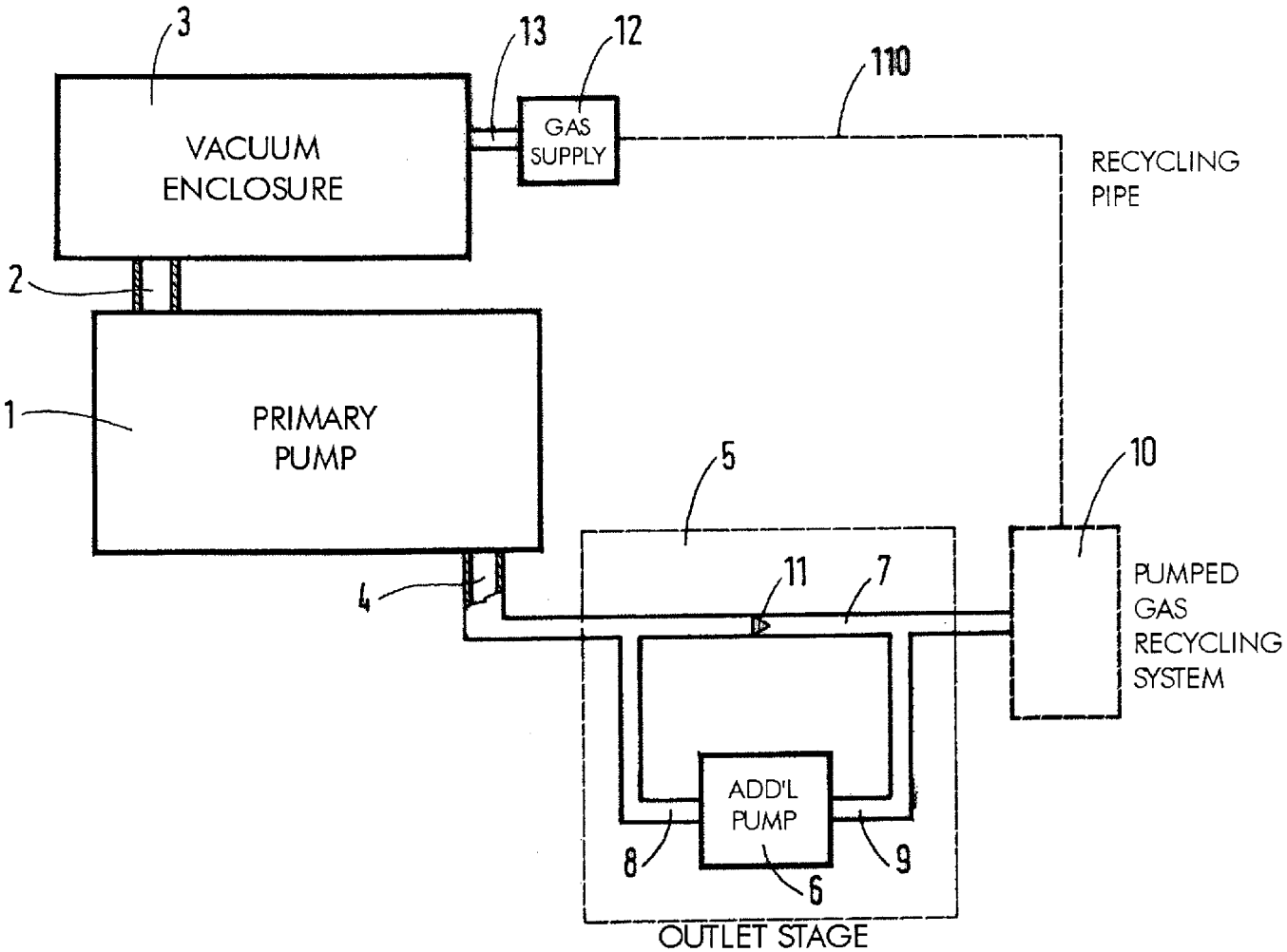
FIG. 1 is a general schematic view of one embodiment of a vacuum pumping system in accordance with the invention connected to a vacuum enclosure.

In the embodiment shown schematically in FIG. 1, a vacuum pumping system according to the invention includes a Roots or claw multistage dry primary pump 1 whose inlet 2 receives from a vacuum enclosure 3 gases to be pumped and whose outlet 4 discharges the pumped gases to an outlet stage 5 including an additional pump 6 and a preliminary evacuation pipe 7.

The additional pump 6 has an inlet 8 connected to the outlet 4 of the primary pump 1, and an outlet 9 that discharges to the outside atmosphere or to a pumped gases recycling system 10.

The preliminary evacuation pipe 7 is connected in parallel with the additional pump 6, i.e. its inlet is connected to the inlet 8 of the additional pump 6 and to the outlet 4 of the primary pump 1, and its outlet is connected to the outlet 9 of the additional pump 6 and to atmosphere or to the pumped gases recycling system 10. The preliminary evacuation pipe 7 includes a check valve 11 which allows the gases to pass from the inlet to the outlet and prevents them flowing from the outlet to the inlet. The check valve 11 therefore passes gases coming from the outlet 4 of the primary pump 1.

The additional pump 6 is a dry pump using a technology other than the Roots or claw technology used for the primary pump 1, and is adapted to withstand without damage the temperature rise due to the final compression of the pumped gases before they are discharged to the atmosphere or to the pumped gases recycling system 10.

Figure 3:
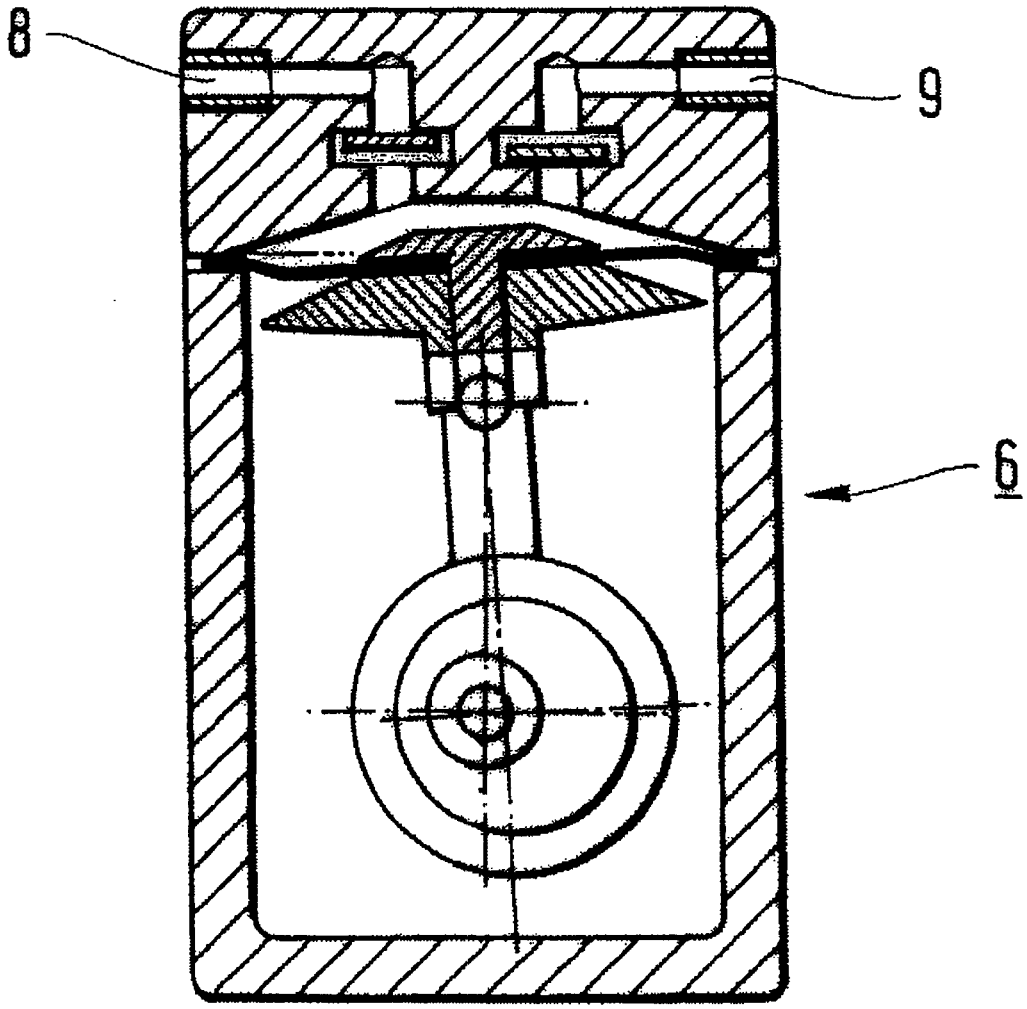
FIG. 3 is a side view in longitudinal section showing a possible membrane pump structure.

A first example of a suitable additional pump is a membrane pump, as shown schematically in FIG. 3. Such a membrane pump is a dry pump, i.e. one which is not sealed by a liquid volume. The membrane pump structure does not include a rotor isolated from the stator by the thin layer of pumped gases.

A second example of a suitable additional pump is a piston pump, which is a structure that is well known in the art. In such a piston pump there is no rotor isolated from the stator by a thin layer of pumped gases.

In both the piston pump and membrane pump technologies, all the components of the pump can be cooled by conduction from the external body of the pump which is itself cooled by a forced cooling circuit, with the result that this kind of additional pump is capable of evacuating the large amount of heat resulting from the final compression of the pumped gases.

The additional pump 6 must be rated so that it is capable of pumping all of the flow of process gas passing through the vacuum pumping system when pumping a vacuum at low pressure. During these steps, in which the pumped gas is at a low pressure, the gas flow is relatively low. It is therefore sufficient for the additional pump to be rated so that it is just capable of pumping said gas flow, so that the inlet 8 of the additional pump 6 is at a pressure much lower than atmospheric pressure, and the primary pump 1 therefore has to provide a low compression ratio, which consequently reduces the heating of the gases that pass through it and the resulting heating of its component parts. To achieve a satisfactory reduction in the gas pressure at the inlet 8 of the additional pump 6, it is sufficient for the additional pump 6 to be capable of pumping all of the gas flow under normal operation conditions, the check valve 11 maintaining the pressure difference between the inlet 8 and the outlet 9 of the additional pump 6.

The preliminary evacuation pipe 7 is needed for the gas flow at a higher flowrate that the primary pump 1 must evacuate at the start of evacuating a vacuum enclosure 3. In this case, the pumped gases generally do not include any low thermal conductivity gas, and the compression to be provided by the last stage of the primary pump 1 is lower than that which the primary pumping system must provide under normal operating conditions, i.e. when the pressure in the vacuum enclosure 3 is very low. The primary pump 1 is therefore capable on its own of effecting the preliminary evacuation of the vacuum enclosure 3, via the preliminary evacuation pipe 7, and the additional pump 6 has no significant effect on the operation of the system. The preliminary evacuation pipe 7 must be rated to pass the large gas flow during the preliminary evacuation of the vacuum enclosure 3.

In the embodiment shown in FIG. 1, the pumped gas recycling system 10 generates a recycled gas flow. The recycled gas flow is directed via a recycling pipe 110 to a controlled gas supply 12 which is in turn connected to the vacuum enclosure 3 by an injector pipe 13 for injecting appropriate quantities of gas into the vacuum enclosure 3 during programmed operating steps.

Figure 2:
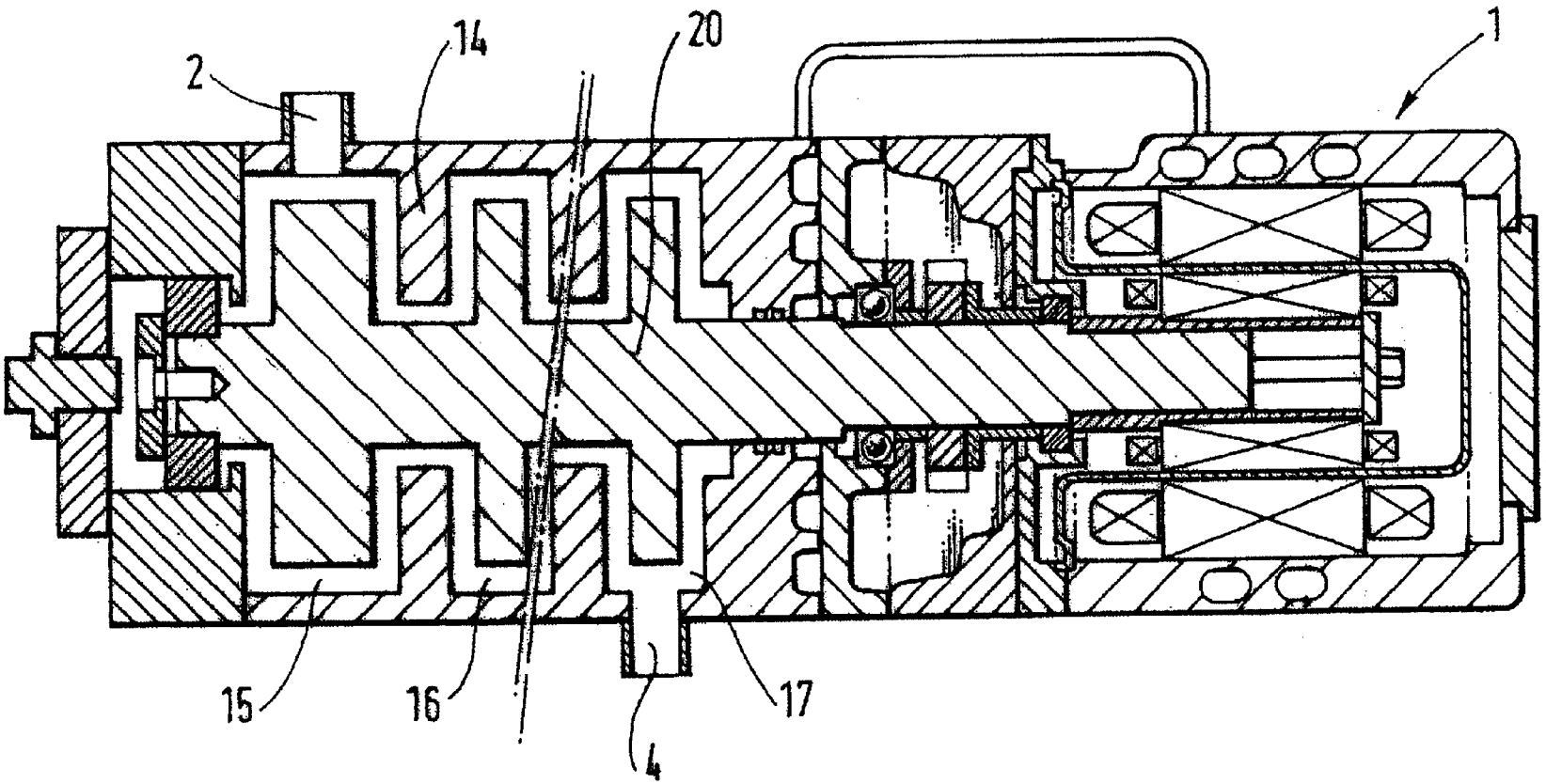
FIG. 2 is a side view in longitudinal section showing a possible multistage Roots pump structure.

The primary pump 1 is a Roots multistage dry pump, for example, as shown more clearly in FIG. 2. In a Roots multistage pump of this kind, the stator 14 defines a succession of compression chambers, for example the compression chambers 15, 16 and 17, in which rotate Roots compressor lobes carried by two parallel and mechanically coupled rotors, such as the rotor 20, with gas passages through which the gases pass successively between the adjacent compression chambers.

The rotors, such as the rotor 20, are rotary parts mounted in bearings, and a clearance is necessarily present between the compressor lobes and the walls of the stator 14. A thin layer of gas is therefore present between the compressor lobes of the rotors and the mass of the stator 14. When pumping low thermal conductivity gas, the thin layer of gas efficiently isolates the compressor lobes of the rotor from the stator, and therefore opposes the flow of heat from the rotors to the stator 14. This results in heating of the rotors, such as the rotor 20.

The heating is more accentuated in the final stage 17 of the primary pump, stage in which the greatest compression of the gases occurs.

The vacuum pumping system according to the invention shown in FIG. 1 reduces the pressure at the outlet 4 of the primary pump 1, so reducing heating of the final stage of the primary pump 1.

This is particularly advantageous when pumping low thermal conductivity gas, and prevents rapid destruction of the primary pump 1.

The system according to the invention operates as follows: at the start of pumping the gases present in a vacuum enclosure 3, the primary pump 1 aspirates the gases at its inlet 2 and compresses them, to discharge them at its outlet 4 at a pressure close to atmospheric pressure. The gas flow is high, and the pumped gas mixtures generally contain gases with a good coefficient of thermal conduction. The Roots multistage primary pump 1 is therefore capable of pumping this gas flow during a preliminary evacuation step. The gases discharged at its outlet 4 mainly escape to the atmosphere through the preliminary evacuation pipe 7 and via the check valve 11. The additional pump 6 passes only a small proportion of the discharged gas flow, its pumping capacity being low.

When the low pressure is established in the vacuum enclosure 3, the vacuum process steps can be carried out, for example semiconductor fabrication process steps. During these steps, i.e. during normal operation, process gases are injected into the vacuum enclosure 3 from the gas supply 12 via the injector pipe 13. These process gases can be insulating gases, such as argon or xenon, in process steps in which these gases are used in light sources emitting in the far ultraviolet spectrum, for example. Because the pumped gas flows being low, the additional pump 6 is capable of pumping all of the gas flow leaving the primary pump 1 via the outlet 4, and there is no flow in the preliminary evacuation pipe 7. As a result of this the additional pump 6 produces a pressure drop at its inlet 8, i.e. at the outlet 4 of the primary pump 1. The primary pump 1 is therefore capable of withstanding the presence of low thermal conductivity gases, such as argon or xenon, in the pumped gas flow, without exaggerated heating of its components.

The pumped low thermal conductivity gases are generally costly gases which it is beneficial to recycle. This is why, at the outlet from the system, the gases are discharged into the pumped gases recycling system 10, which itself returns the recycled gases via the recycling pipe 110 to the gas supply 12, for subsequent re-injection into the vacuum enclosure 3.

The present invention is not limited to the embodiments explicitly described, but includes variants and generalizations thereof that will be obvious to the person skilled in the art.

What is claimed is:

1. A vacuum pumping system including a Roots or claw multistage dry primary pump which has an inlet adapted to receive gases to be pumped and an outlet adapted to discharge pumped gases to the atmosphere or to a pumped gas recycling system, an additional pump which has an inlet connected to said outlet of said primary pump and an outlet that discharges to the atmosphere or to said pumped gas recycling system and is a dry pump that uses a technology other than the Roots or claw technology and is adapted to withstand without damage the temperature increase due to the final compression of the pumped gases, and a preliminary evacuation pipe connected in parallel with said additional pump and including a check valve adapted to pass gases coming from said primary pump.

2. The vacuum pumping system claimed in claim 1 wherein said additional pump is a membrane pump.

3. The vacuum pumping system claimed in claim 1 wherein said additional pump is a piston pump.

4. The vacuum pumping system claimed in claim 1 wherein said additional pump is rated to pump all of the flow of gas passing through said vacuum pumping system when pumping a vacuum at low pressure.

5. The vacuum pumping system claimed in claim 4 wherein said additional pump is rated to be just capable of pumping said flow of gas when pumping a vacuum at low pressure.

6. The vacuum pumping system claimed in claim 1 wherein said preliminary evacuation pipe is rated to pass the high gas flow during preliminary evacuation steps of a vacuum enclosure.

7. The vacuum pumping system claimed in claim 1 adapted to be connected to a vacuum enclosure containing or into which are injected low thermal conductivity gases.

8. The vacuum pumping system claimed in claim 7 wherein said low thermal conductivity gases include argon or xenon.

9. The vacuum pumping system claimed in claim 7 wherein said pumped gases are discharged into a pumped gas recycling system which extracts and recycles said low thermal conductivity gases.

* * * * *